US010196868B2

(12) United States Patent
Layden

(10) Patent No.: US 10,196,868 B2
(45) **Date of Patent: *Feb. 5, 2019**

(54) APPARATUS AND METHODS FOR DOWNHOLE TOOL DEPLOYMENT FOR WELL DRILLING AND OTHER WELL OPERATIONS

(71) Applicant: Raptor Rig Coil, Inc., Calgary (CA)

(72) Inventor: Reginald Waye Layden, Calgary (CA)

(73) Assignee: Raptor Rig Coil, Inc., Calgary (CA)

( * ) Notice: Subject to any disclaimer, the term of this patent is extended or adjusted under 35 U.S.C. 154(b) by 139 days.

This patent is subject to a terminal disclaimer.

(21) Appl. No.: 15/251,506

(22) Filed: Aug. 30, 2016

(65) Prior Publication Data

US 2016/0369580 A1 Dec. 22, 2016

Related U.S. Application Data

(62) Division of application No. 14/468,655, filed on Aug. 26, 2014, now Pat. No. 9,624,741.

(51) Int. Cl.

| | |
|---|---|
| ***E21B 19/22*** | (2006.01) |
| ***E21B 17/20*** | (2006.01) |
| ***E21B 15/00*** | (2006.01) |
| ***E21B 19/08*** | (2006.01) |
| ***E21B 33/068*** | (2006.01) |

(52) U.S. Cl.

CPC ..... *E21B 19/22* (2013.01); *E21B 15/003* (2013.01); *E21B 17/20* (2013.01); *E21B 19/08* (2013.01); *E21B 33/068* (2013.01)

(58) Field of Classification Search

CPC ..... E21B 19/22; E21B 17/20; E21B 19/00

See application file for complete search history.

(56) References Cited

U.S. PATENT DOCUMENTS

| | | | | |
|---|---|---|---|---|
| 4,863,091 | A | 9/1989 | Dubois | |
| 5,924,754 | A | 7/1999 | Kuhns | |
| 6,431,286 | B1 * | 8/2002 | Andreychuk | E21B 19/22 166/384 |
| 6,973,979 | B2 | 12/2005 | Carriere | |
| 7,640,999 | B2 * | 1/2010 | Patton | E21B 7/02 166/77.2 |
| 7,681,632 | B2 * | 3/2010 | Wood | E21B 7/02 166/77.1 |
| 7,845,398 | B2 | 12/2010 | Wood | |
| 2004/0206551 | A1 * | 10/2004 | Carriere | E21B 15/00 175/203 |

(Continued)

FOREIGN PATENT DOCUMENTS

| | | |
|---|---|---|
| AU | 2010100358 A4 | 5/2010 |
| CA | 2533725 | 10/2006 |

OTHER PUBLICATIONS

Non-Final Office Action dated Feb. 4, 2016, in Canadian Application No. 2,860,717.

(Continued)

*Primary Examiner* — Brad Harcourt
*Assistant Examiner* — Steven A MacDonald
(74) *Attorney, Agent, or Firm* — Ramey & Schwaller

(57) ABSTRACT

The disclosure herein relates generally to devices and methods usable during well drilling and surface operations. More particularly, the disclosure herein relates to a rig incorporating a coiled tubing injector that engages downhole tools.

11 Claims, 6 Drawing Sheets

(56) References Cited

U.S. PATENT DOCUMENTS

| | | | | |
|---|---|---|---|---|
| 2006/0207767 | A1* | 9/2006 | Andreychuk | E21B 19/22 166/379 |
| 2006/0231267 | A1* | 10/2006 | Wood | E21B 7/02 166/379 |
| 2006/0231268 | A1* | 10/2006 | Wood | E21B 7/02 166/379 |
| 2006/0289170 | A1* | 12/2006 | Wood | E21B 7/02 166/380 |
| 2006/0289171 | A1* | 12/2006 | Wood | E21B 7/02 166/380 |
| 2007/0125551 | A1* | 6/2007 | Havinga | E21B 15/00 166/384 |
| 2007/0125552 | A1* | 6/2007 | Wood | E21B 7/02 166/385 |
| 2008/0251248 | A1* | 10/2008 | Havinga | E21B 15/04 166/77.3 |
| 2013/0341001 | A1* | 12/2013 | Kos | E21B 19/22 166/77.2 |
| 2014/0000867 | A1* | 1/2014 | Andreychuk | E21B 19/00 166/77.2 |
| 2015/0315861 | A1* | 11/2015 | Zachariasen | E21B 19/22 166/385 |

OTHER PUBLICATIONS

Non-Final Office Action dated Jan. 4, 2017, in Canadian Application No. 2,860,717.

Non-Final Office Action dated Oct. 13, 2016, in U.S. Appl. No. 14/468,655.

Extended European Search Report dated Apr. 17, 2018, in European Application No. 15836314.3.

* cited by examiner

APPARATUS AND METHODS FOR DOWNHOLE TOOL DEPLOYMENT FOR WELL DRILLING AND OTHER WELL OPERATIONS

RELATED APPLICATIONS

This application is a divisional of U.S. application Ser. No. 14/468,655, filed Aug. 26, 2014, incorporated herein by reference.

FIELD

The disclosure herein relates generally to devices and methods usable during well drilling and surface operations. More particularly, the disclosure herein relates to a rig incorporating a coiled tubing injector that engages downhole tools.

BACKGROUND

Historically, subterranean wells have been drilled by rotating a bit attached to the end of jointed pipe or tubing sections. The jointed pipe string is rotated from the surface, which rotation is transferred to the bit. As the rotating bit drills into the earth, additional sections or joints of pipe must be added to drill deeper. A significant amount of time and energy is consumed in adding and removing new sections of pipe to the drill string.

Coiled tubing, such as described in U.S. Pat. No. 4,863,091, is available in virtually unlimited lengths and has been used for a variety of purposes in the exploration and production of hydrocarbons from subterranean wells. Coiled tubing is widely used in the oil and gas industry for a variety of purposes and applications, including, but not limited to, drilling, completion, and work over operations. For example, coiled tubing may be run into a subterranean well to produce hydrocarbons from the subterranean formation, to fracture or perforate the subterranean formation, to perform well data acquisition, introduce fluids, and to clean out the wellbore.

Coiled tubing is typically supplied to the oilfield on a large spool or reel that contains thousands of feet of continuous, relatively thin-walled tubing that typically has an outside diameter between about 1" to 4.5". During use, the tubing is spooled off the reel and onto a device or "gooseneck" that bends and guides the coiled tubing into another device, such as an injector head. The injector head functions to grip the tubing and mechanically force it into, and withdraw it from, the wellbore.

Coiled tubing rigs primarily consist of an injector head for inserting and removing the coiled tubing from the wellhead, a spool reel for storing and transporting the coiled tubing, a power pack to power the injector head, and a control room to operate the machinery.

A typical coiled tubing injector is comprised of two continuous chains, though more than two can be used. The chains are mounted on sprockets to form elongated loops that counter rotate. A drive system applies torque to the sprockets to cause them to rotate, resulting in rotation of the chains. In most injectors, chains are arranged in opposing pairs, with the pipe being held between the chains. Grippers carried by each chain come together on opposite sides of the tubing and are pressed against the tubing. The injector thereby continuously grips a length of the tubing as it is being moved in and out of the well bore. The "grip zone" or "gripping zone" refers to the zone in which grippers come into contact with a length of tubing passing through the injector.

A drive system for a coiled tubing injector includes at least one motor. For larger injectors, intended to carry heavy loads, each chain will typically be driven by a separate motor. The motors are typically hydraulic, but electric motors can also be used. Each motor is coupled either directly to a drive sprocket on which a chain is mounted, or through a transmission to one or more drive sockets. Low speed, high torque motors are often the preferred choice for injectors that will be carrying heavy loads, for example long pipe strings or large diameter pipe. However, high speed, low torque motors coupled to drive sprockets through reduction gearing are also used.

The coiled tubing injector head is conventionally positioned above the wellhead. In work over operations, for example, the injector head may be suspended above the wellbore by a crane or other device. A lubricator may be used to connect the injector head to the wellhead (including, for example, a blowout preventer) at the top of the wellbore to prevent the coiled tubing from buckling or otherwise deforming prior to entering the wellbore.

Typically, coiled tubing operations are performed from a crane where the crane suspends the injector above the wellbore and the injector deploys the coiled tubing downhole. Further, in this configuration, lubricators are positioned between the wellbore and the injector in a substantially vertical manner. In these applications, the lubricators are often load-bearing themselves. Overhead loads can fall and pose a danger to people around the coiled tube injector.

It is therefore advantageous to develop apparatuses and methods of transmitting coiled tubes downhole from a horizontal position. Further, without cranes, the injector is easier to move from wellhead to wellhead. In such applications, it is also advantageous to have a coil tubing lubricator substantially parallel to and near ground level with respect to the tubing for lubricating and assembly of downhole tools.

SUMMARY

Certain embodiments of the invention herein concern a coiled tubing service rig comprising: a mast having a long axis; a base structure for the mast, the mast pivotally mounted to the base structure, wherein the mast is able to pivot from a position substantially parallel to ground to substantially perpendicular to ground; a coiled tubing injector mounted to the mast and able to travel longitudinally along the mast from a position near to the base structure when the mast is perpendicular to the ground to a position away from the base structure when the mast is perpendicular to the ground, the coiled tubing injector further being able to rotate from a position substantially parallel to the long axis to a position substantially perpendicular to the long axis; and a pipe comprising at least one lubricator, the pipe having one end connected to the injector and another end not connected to the injector.

In further embodiments concerning the pipe, when the pipe is in a horizontal position, coiled tubing is capable of being passed through the injector in a horizontal position, through the lubricator and out the end of the lubricator oriented away from the tubing injector. In this embodiment, a downhole tool is capable of being attached to the coiled tubing.

In certain embodiments, the coiled tubing is fed to the injector by a spool capable of rotation and positioned on a coiled tubing transporter trailer.

Additionally, in certain embodiments, the pipe comprises a plurality of lubricators, each with a bottom end and a top end wherein the top end of one of the plurality of lubricators is connected to the bottom end of another one of the plurality of lubricators, the plurality of lubricators forming an elongated chain of lubricators with a top end of the elongated chain connected to the injector.

Still further, concerning the injector, the injector moves to a position substantially away from the base structure, thereby causing the pipe to move to a vertical position. Likewise, the injector rotates from a position substantially perpendicular to the long axis to a position substantially parallel to the long axis as the injector moves away from the base structure.

Additionally, the injector is capable of extending coiled tubing to the bottom of the elongated chain when the chain is either in a substantially parallel or substantially perpendicular position with respect to the ground.

In further embodiments concerning the rig, when the mast is pivoted to a substantially parallel position with respect to the ground, the rig is capable of being transported on public roadways.

Additionally, when the mast is perpendicular to the ground, the injector is capable of being in alignment with a wellbore or out of alignment with the wellbore. In such embodiments, the mast moves in a position of being in alignment with the wellbore to being out of alignment with the wellbore. In other embodiments, the injector moves in a position of being in alignment with the wellbore to a position of being out of alignment with the wellbore.

Additional embodiments concern methods of assembling such a rig.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the detailed description of various embodiments usable within the scope of the present disclosure, presented below, reference is made to the accompanying drawings, in which.

LIST OF REFERENCE NUMERALS

Figure 1:
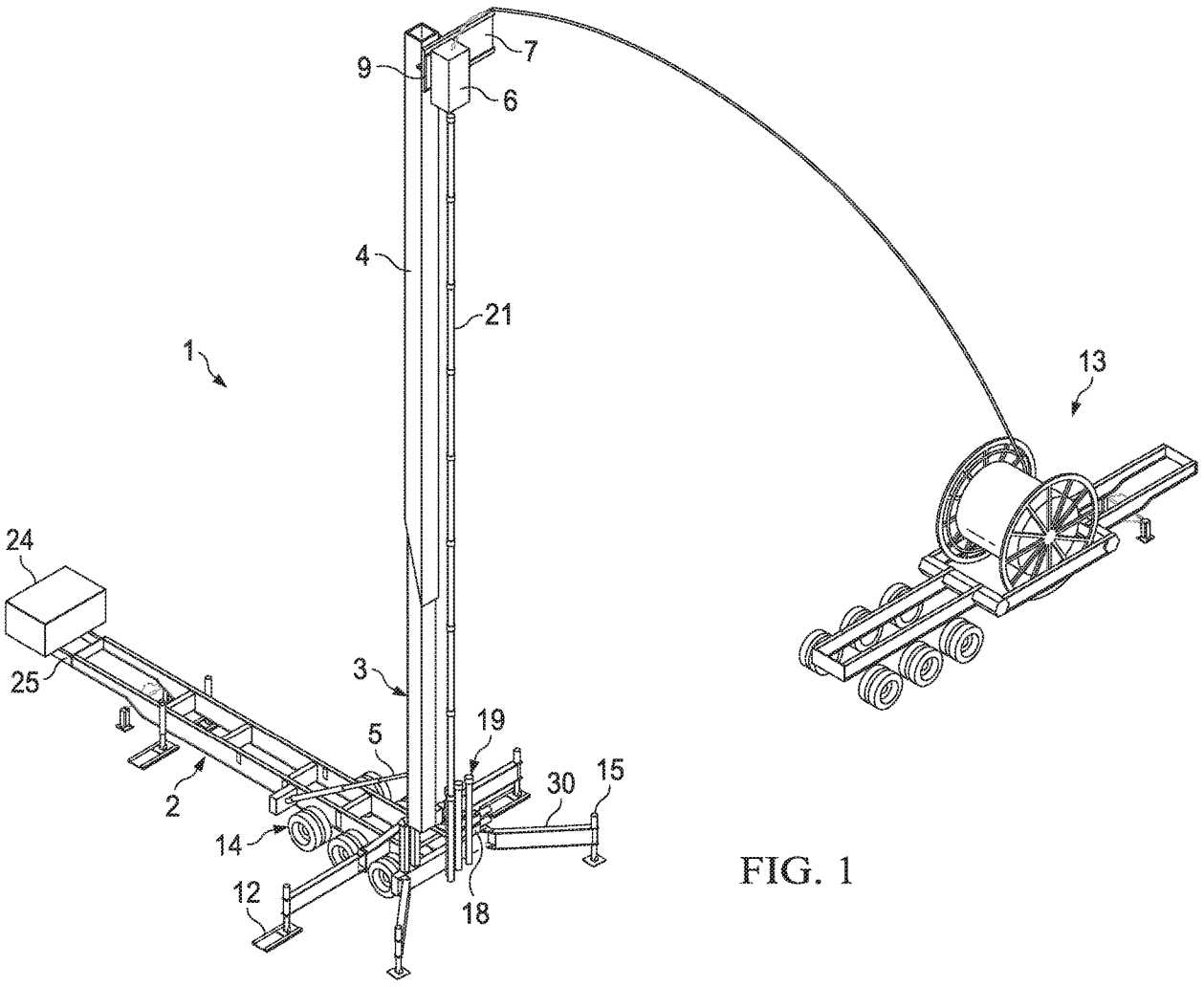
FIG. 1 depicts an isometric view of a mobile coiled tubing drilling and service rig usable within the scope of the present disclosure.

1 rig
2 base structure
3 lower mast assembly
4 upper mast assembly
5 raising assembly
6 coiled tubing injector
7 sliding frame
9 slide frame
12 slidable platforms
13 coiled tubing transport trailer
14 wheeled axles
15 hydraulic cylinders
18 well control equipment
19 lubricators
20 down hole tools
21 horizontal lubricators
22 lubricator stand
23 down hole tool stand
24 well control accumulators
25 frame
26 slide mechanism
27 cross members
28 coiled tubing reel support structures
29 variable sized tubing reel
30 support arms

DETAILED DESCRIPTION

Introduction

We show the particulars shown herein by way of example and for purposes of illustrative discussion of the preferred embodiments of the present invention only. We present these particulars to provide what we believe to be the most useful and readily understood description of the principles and conceptual aspects of various embodiments of the invention. In this regard, we make no attempt to show structural details of the invention in more detail than is necessary for the fundamental understanding of the invention. We intend that the description should be taken with the drawings. This should make apparent to those skilled in the art how the several forms of the invention are embodied in practice.

We mean and intend that the following explanations are controlling in any future construction unless clearly and unambiguously modified in the following examples or when application of the meaning renders any construction meaningless or essentially meaningless. In cases where the construction of the term would render it meaningless or essentially meaningless, we intend that the definition should be taken from Webster's Dictionary 3rd Edition.

The term "downhole" means the wellbore at the surface to the deepest part of the drilled well when drilled vertically or diagonally or directionally.

The terms "bottom", "lower", and "lowest" refer to the direction towards or to the deepest part of the drilled well when drilled vertically, diagonally or directionally.

This disclosure deviates from the current practice of using coiled tubing in oil and gas applications. Conventional coiled tubing service or drilling work is performed using an injector, a load bearing scaffolding to suspend the injector over a well bore, and sections of lubricator. Alternate methods include the use of a crane and load bearing lubricators to suspend the injector over the well bore instead of scaffolding, or a mast and load bearing lubricators to suspend the injector over the wellbore. The inventions disclosed herein dispense with the conventional use of a crane over a wellbore with an injector overhead. Further, the inventions disclosed herein dispense with load bearing lubricators positioned in a vertical direction and positioned in between the injector and the wellbore.

In conventional applications, an injector is mounted on a series of lubricators mounted vertically in-line with a well bore for deploying downhole tools into the wellbore. In these conventional applications, the tools are threadably connected to the coiled tubing and traveled vertically into the wellbore by actuating the injector. The wellbore is often under pressure and the lubricators in this case are usually sealed to the wellhead and the injector to prevent the venting of well bore pressure.

In these conventional applications, when the injector is mounted on scaffolding, the scaffolding must be of sufficient height to allow the total length of lubricators to be assembled below the injector in the space between the injector and the wellhead. The lubricators are typically assembled to the bottom of the injector in small sections, typically ten feet or less.

With the injector suspended from a crane, the lubricators are assembled to the injector in small sections as the injector is traveled vertically by the crane to accommodate the addition of more lubricator sections. Again, in these conventional configurations, coiled tubing is traveled in the sections of lubricators by the injector until it exits the sections of lubricators at the bottom. Sections of downhole tools are assembled vertically to the coiled tubing. The coiled tubing is traveled vertically up into the lubricators to draw the section of tool into the lubricator. Another section of tool is assembled to the first section of tool and this is repeated as number of times as necessary to insert as many sections of tools as can be accommodated in the length of lubricators. In these conventional methods, with the injector suspended from a crane and mounted to sections of lubricator mounted to well control equipment on the top of a well bore, the lubricator and the well control equipment is in axial compression potentially up to the pulling capacity of the injector in addition to the weight of the injector and lubricators. The series of lubricators and tools can remain suspended vertically from the injector while the crane travels the injector to an adjacent well bore.

However, in all these conventional systems, the disadvantage of suspending the injector from a crane remains. More specifically the axial compressive loading is placed upon the lubricators and well control equipment. Further, the scaffolding must be disassembled, moved to the next well and then reassembled. Further, the coiled tubing, if mounted on its own platform separated from the injector, must be spooled onto a reel and removed from engagement with the injector for separate transport. Likewise, the amount of coiled tubing transportable is limited by the maximum transport dimensions and weights allowable by law.

In conventional systems, in order to transport the amount of coiled tubing required for the longest reach well bore, the trailer sometimes needs to transport more than is needed for other well bores. This requires the reel trailer to obtain permits for transport. Permits are time consuming to obtain and expensive. In fact, the reel trailer is required to obtain permits even when traveling empty with no coiled tubing.

A coiled tubing transport trailer could telescope from a highway legal width with either a narrow coiled tubing storage reel or no storage reel to a width sufficient to accommodate a large capacity coiled tubing storage reel.

The embodiments of the present disclosure pertain to a combination of a coiled tube injector which is movable and integrated into a trailer such that setup and removal of scaffolding is no longer required. This saves time and money. Likewise, the present disclosure pertains to a second movable unit, namely a coiled tubing trailer.

In the embodiments concerning the coiled tube injector which is integrated into a trailer, the trailer further comprises a mast system onto which the telescoping injector is mounted.

Typically, the mast system is able to move from a substantially horizontal position wherein it can be transported on the trailer to a substantially vertical position wherein it is generally in line with a wellbore shaft drilled in a vertical position.

However, the movable mast is able to move to an angle which is either 0 degrees with respect to the wellbore or 90 degrees with respect to the wellbore shaft as necessary.

In specific embodiments regarding the mast system, the mast system can be a set length. However it is contemplated that in many embodiments the mast system will decrease in length or increase in length in a telescoping manner. This can be done through a hydraulic or mechanical actuator to extend or contract two or more sections of mast.

In alternative embodiments, sections of mast can be added on or removed manually until the mast reaches the desired length for operation.

In many of the contemplated embodiments, when the mast is telescoping, the mast subsections are in line such that one part of the telescoping mast fits almost or completely inside another section of the telescoping mast, as one would see in a hand held telescope. In other embodiments, some or all sections are not in line, but are adjacent to one another. This principle is often used in the telescoping of forklifts and the like. Still further, in certain embodiments wherein different heights are desired, the mast parts do not slide within each other or adjacent to one another, but are extended and contracted by hydraulic arms such as is commonly seen on construction equipment such as a backhoe.

In specific embodiments regarding the coiled tubing injector, the injector is operatively attached to the mast system. In these embodiments, the coiled tubing injector is rotatable with respect to the mast system such that it is able to drive coiled tubing perpendicular, diagonal or parallel to the mast system. The manner in which the tubing injector rotates can be any manner. Certain ways the tubing injector can rotate is through a gear mechanism, a hydraulic mechanism or a pneumatic mechanism. Alternatively, the tubing injector can be rotated to the desired position by a worker and secured at the desired angle by anchoring pins, bolts, screws and the like.

In still further embodiments concerning the coiled tubing injector, the tubing injector is slidably disposed along the mast system. The tubing injector in certain embodiments moves along a track, rail, pipe or the like which is itself positioned along the mast system. Upon movement, the tubing injector is secured via micro breaks, pneumatic mechanisms, hydraulic mechanisms and the like. In other embodiments, after movement of the tubing injector, the injector is re-secured through the use of bolts, pins, screws, clamps and the like.

Figure 2:
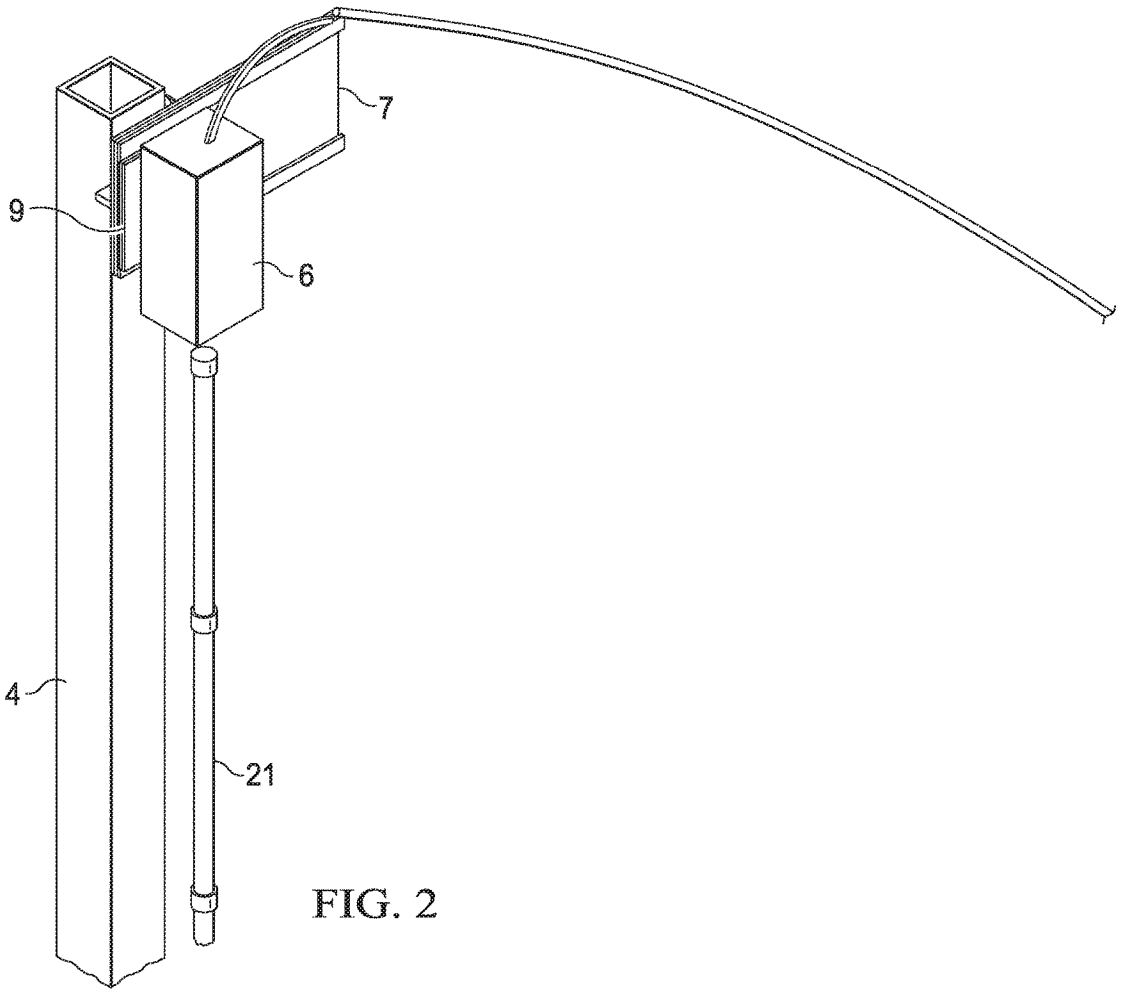
FIG. 2 depicts an isometric view of an injector manipulating structure.

Still further, the tubing injector in certain embodiments is slidably disposed to be in line or out of line with the wellbore shaft. In such embodiments, the direction that the tubing injector pushes the tubing is parallel to the upraised mast system. In some instances this is not in line with the lubricators which are typically below the tubing injector or the shaft of the wellbore. In other instances, the upper end of the lubricator string is attached to the injector. In this case, both the lubricators and injector move relative to the wellbore shaft. Although the tubing injector is often slidably disposed in such a manner, the disclosure herein also contemplates that the tubing injector can be moved from one position to another and then secured to the mast by mechanisms previously discussed. As seen in FIG. 2, the injector is on a sliding frame. Further, as seen in FIG. 2, the sliding frame is capable of bending up to 90 degrees to further push the injector out of line with the wellbore. Also, by moving the sliding frame and the injector, when the mast is collapsed back onto a trailer, the injector can be out of the way to facilitate transport.

Certain embodiments concern the lubricator for the coiled tubing. In many embodiments, the mast system is in a substantially perpendicular system to the ground and a parallel position to the shaft of the wellbore. When in this aforementioned position, coiled tubing is pushed through the tubing injector, through the lubricator and into the wellbore.

However, an aspect of the invention disclosed herein concerns a lubricator in conjunction with the mast system wherein the lubricator is initially in a horizontal position which is generally parallel to the ground. In this embodiment, the lubricator sections are attached together and one end is operatively attached to the injector or the mast. In the embodiments concerning the horizontal lubricator, the coiled tubing is pushed through the injector and into the lubricator sections. At the far end of the lubricators (away from the injector) downhole tools can be attached to the coiled tubing. After attachment and the tools have been drawn into the lubricator, the injector and lubricators are raised to the vertical position as discussed above. The raising method is generally accomplished by moving the injector up the mast and by telescoping the mast for additional vertical travel while the injector, the lubricators, the coiled tubing in the lubricators and the wellbore tool (or tools) rotate to be in a position in line or at least parallel to the wellbore.

An advantage of this configuration is the allowance of the attachment of downhole tools in a horizontal position, which can be safer than having workers assemble downhole tools overhead where there is a risk of dropping and injuring workers. Still further, in typical arrangements, the lubricator sections and the downhole tools must be assembled in steps rather than the lubricator being assembled all at once. This in part is due to the inability of attaching downhole tools to the coiled tubing when the bottom end of a fully assembled lubricator in a vertical position is close to or abutting the ground.

Further embodiments of the invention concern the mast mechanism and the counterweight often needed to support the force applied to the rig during operations wherein coiled tubing is lowered into the wellbore or raised from the wellbore. In these embodiments, the counterweight is an accumulator which is generally positioned at the opposite end of the trailer from the mast. Regulations in North America tend to require that the counterweight or accumulator be positioned away from the wellbore such that it does not interfere with emergency operations such as the use of a blow-out preventer. With the accumulator as part of the trailer, the accumulator can move toward the mast when upright or away from the mast to provide the proper counterbalance. Additionally, the accumulator, in certain embodiments, can slidably extend or otherwise extend from the end of the trailer opposite the mast. Still further, in certain embodiments, the accumulator can travel outside of the frame of the trailer such that it is to the left or right of the trailer.

Still further, when referring to the coiled tubing transporter, in many embodiments, the coiled tubing transporter is on a tractor trailer such as one that would be pulled by a truck such as a commercial 18 wheeler or in certain cases a pickup truck or other work truck. It is generally envisioned that the trailer would be one capable of being transported on public roads in most embodiments so as to be able to get to wellbores that are located a great distance from one another. However, due to the size of the spool onto which the coiled tubing is placed, special permits are sometimes required as the spool can be wider than what is normally allowed for transportation on public roads. An advantage of the coiled tubing transporter system is that it possesses a drop in drum system such that at the site, the trailer can be widened to accept the spool so that it can rotate and the coiled tubing can be fed into the wellbore.

During transportation, if the spool is narrow enough to allow for transportation on public roadways, the spool axis can remain perpendicular to the long axis of the length of the trailer. The trailer can be considered to have a long axis which is the length of the trailer and a short axis which is the width of the trailer. The length and width of the trailer should be understood to be measured in a manner typical with normal multi-wheel trailers capable of traveling on public roads.

If the spool is not narrow enough to allow for transportation on public roadways, a crane can lift the spool and rotate it such that the spool axis is parallel to the long axis of the trailer. In this manner the spool can be moved from one wellbore to another on public roads.

An advantage of the adjustable drop in drum system is that when a trailer is not carrying a spool, the trailer can become narrower such that no special permits are needed due to oversized or wide load problems on public roads. Another advantage is that if the axis of the spool is narrow enough to fit without any or much expanding of the trailer, transport of the trailer does not require the aforementioned permits.

Another aspect of the present invention concerning the trailer herein and the slidable platforms as seen in FIG. 1, is that the entire rig is skiddable from well to well. This allows the mast to move up to several meters from one wellbore to another. Additionally, because the invention in the common configuration is on a trailer, the rig can be trucked. In either application, the rig can be moved with a substantial length of lubricator attached to the injector.

EXAMPLES

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit or scope of the invention. The following Examples are offered by way of illustration and not by way of limitation.

Referring now to FIG. 1, The coiled tubing drilling and service rig (1), hereafter referred to as the coil rig, comprises a base structure (2), a lower mast assembly (3), a upper mast assembly (4), a raising assembly (5), a coiled tubing injector (6), hereafter referred to as an injector The base structure (2) is shown having a generally flat rectangular surface, adapted to support and the mast assembly (3, 4), which is depicted as above the base structure. The base structure (2) is also shown having a means for mobility of the rig (1) associated therewith, which is depicted as a plurality of wheeled axles (14) which can include a corresponding suspension system (not shown) and similar components to allow the coil rig (1) to be pulled by a standard truck (not shown) or similar vehicle, in the manner of a mobile trailer. However, the embodiments also conceive of a rig of the present invention which does not have wheeled axles. For example, if the rig is used for offshore applications, wheeled axles would likely not be included. In the embodiment depicted, the base structure (2) includes an apparatus for stabilizing the drill rig (1) during operations. As seen in FIG. 1, the base structure (2) possesses a plurality of support arms (30) which, in this depiction, are movable to contact the ground to provide leverage and/or stability to the drill rig (1). For convenience, the stabilizing arms are depicted as fitted with hydraulic cylinders (15) that travel the coil rig (1) vertically. The cylinders in this embodiment are depicted as being outfitted with slidable platforms (12) that enable the coil rig (1) to travel in any direction for proper alignment with the well bore.

Further, in FIG. 1, the embodiment depicts the mast (3,4) being pivotally mounted to the support structure (2). In this depiction, the lifting assembly (5) is able to pivot the mast (3,4) from a substantial horizontal position to a substantially vertical position. Further, in this depiction, the upper mast (4) travels vertically along axis of the lower mast (3). More specifically, in this depiction, the upper mast (4) telescopes upward and downward in relation to the lower mast (3).

Well control accumulators (24), as depicted in FIG. 1, are mounted on a frame (25) which transposes the accumulator from a transport position to a position outside the well control zone.

Now referring to FIG. 2, the injector (6) is mounted on a sliding frame (7) which allows the injector to travel laterally inline and out of line with the well bore. The sliding frame (7) is also able to fold up to 90 degrees around the mast such that it can further rotate the injector or move the injector in place for transport. The injector (6) travels vertically on a slide frame (9) via a hydraulic cylinder (not shown) or other systems such as cable systems and the like to allow engagement of the lubricators with the well control equipment (not shown). The injector (6) pivots on sleeve (not shown) to orientate from a substantially vertical position to a substantially horizontal position.

Figure 3:
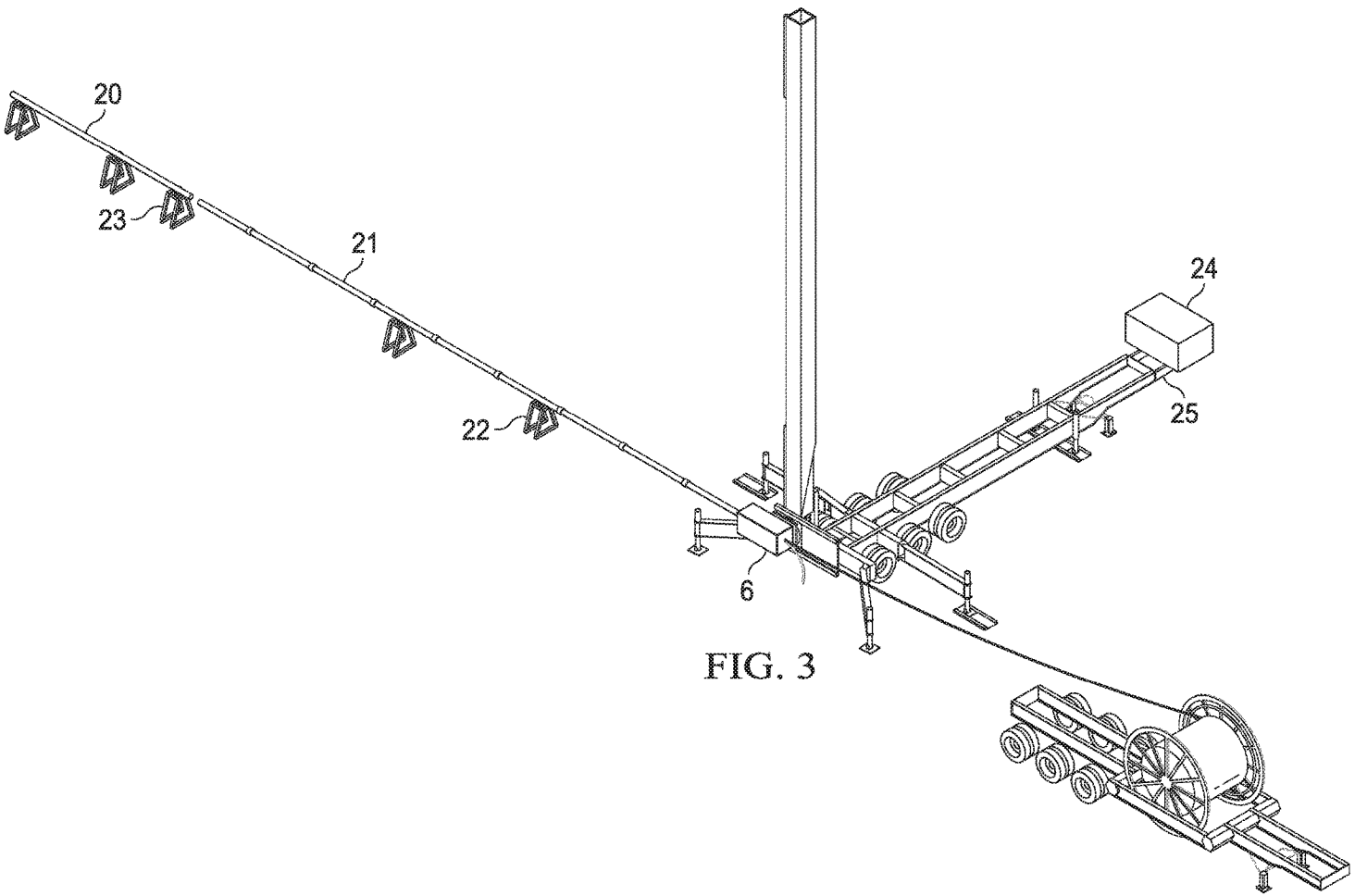
FIG. 3 depicts an isometric view of a mobile coiled tubing drilling and service rig loading tools into a horizontally positioned lubricator.

Referring to FIG. 3. The injector (6) is shown in a substantially horizontal position for loading of downhole tools (20) into the substantial horizontal lubricators (21). The lubricators are support by a lubricator stand (22) as depicted in this figure. The downhole tools (20) are supported by a downhole tool stand (23) which clamps the downhole tools (20) and manipulates them in vertical and horizontal direction to engage the coil tubing (21). As further depicted in FIG. 3, the lubricators are connected to the injector (6). When the injector (6) is pulled up to the mast, the lubricators are in a vertical position and the downhole tools and coiled tubing can be lowered into the wellbore. Further, the coiled tubing can continue to be lubricated as it is fed into the wellbore after the lubricators are in the vertical position.

Figure 4:
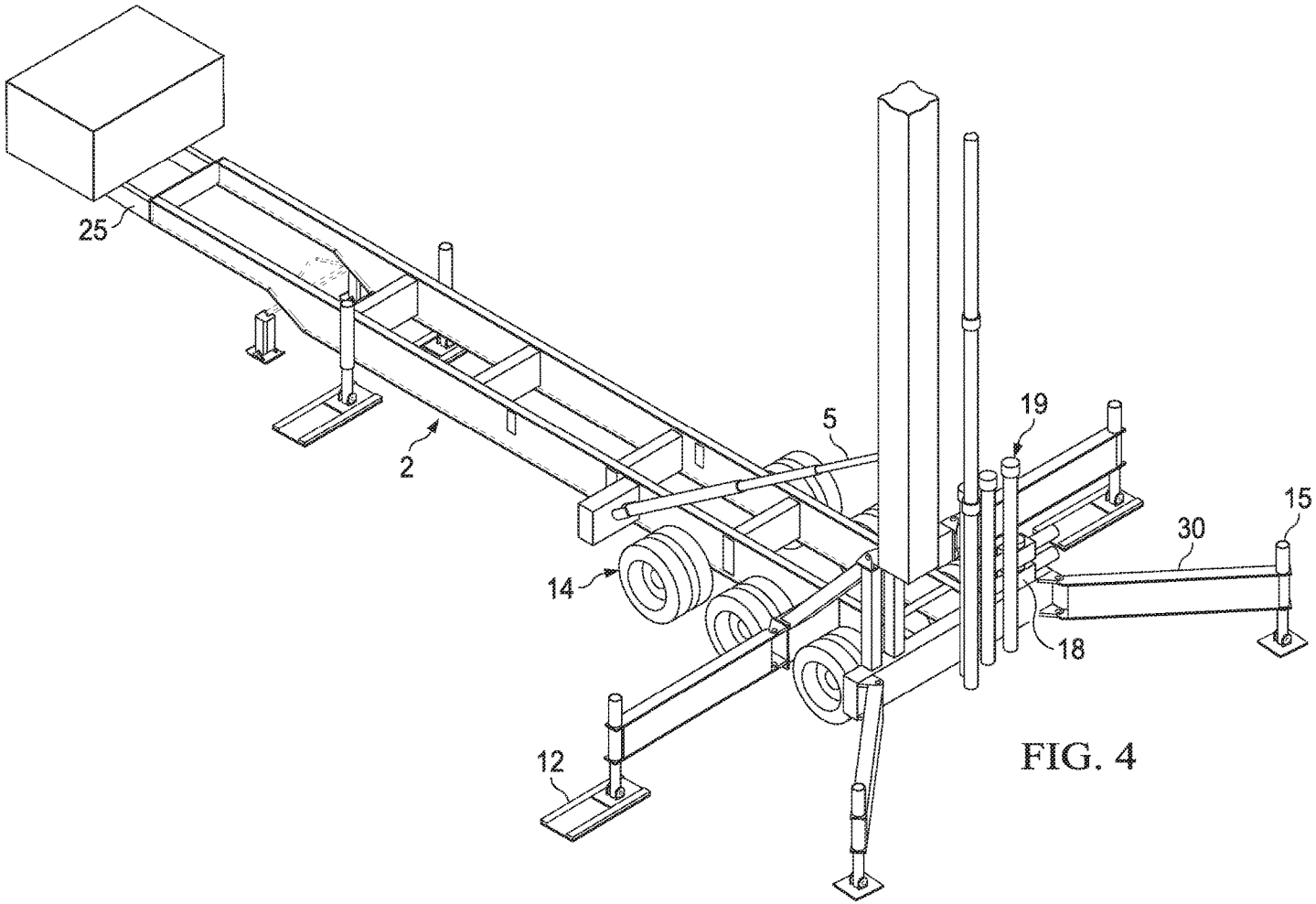
FIG. 4 depicts an isometric view of a lubricator and BOP storage.

Referring to FIG. 4, the lubricators (19) are stored vertical on the support structure (2), and the well control equipment (18) is stored vertically on the support structure (2). The injector (not shown) when transposed laterally out of alignment with the well bore is now able to pick up stored lubricators (19) and well control equipment (18) from the support structure (2).

Figure 5A:
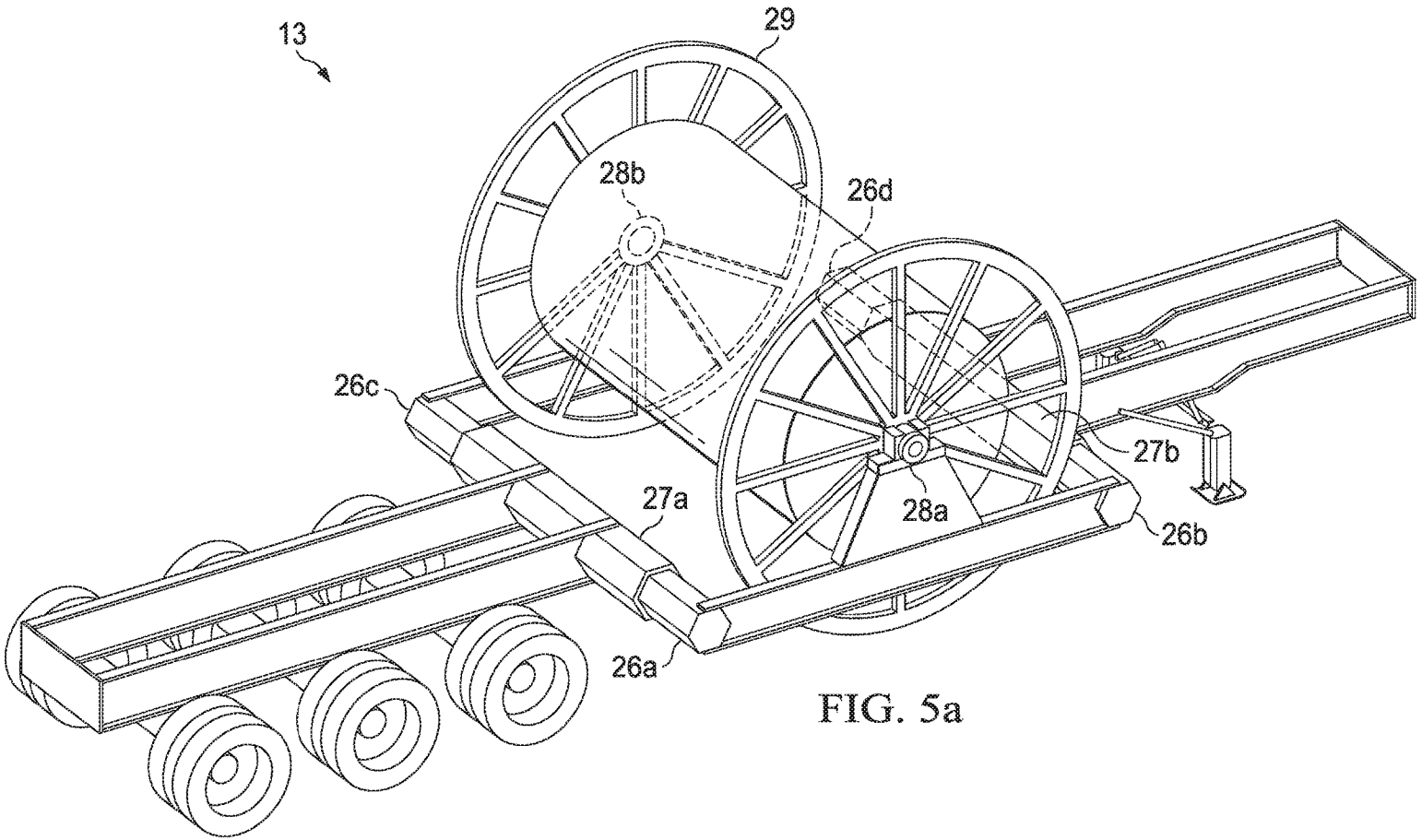
FIG. 5*a* depicts an isometric view of a coiled tubing transport trailer with the variable width drop in drum system telescoped to a width to accommodate a large capacity storage reel.

Referring to FIG. 5*a*, the coiled tubing transport trailer (13) supports the slide mechanism (26*a*, 26*b*, 26*c*, 26*d*) which travels laterally along the axis of cross members (27*a*, 27*b*) to increase the width between the coiled tubing reel support structures (28*a*) and (28*b*) to provide sufficient space to accommodate a variable sized tubing reel (29). The slide mechanism (26*a*, 26*b*, 26*c*, 26*d*) may be fitted with a hydraulic cylinder or other means known to those skilled in the art to provide motive power for the lateral transition.

Figure 5B:
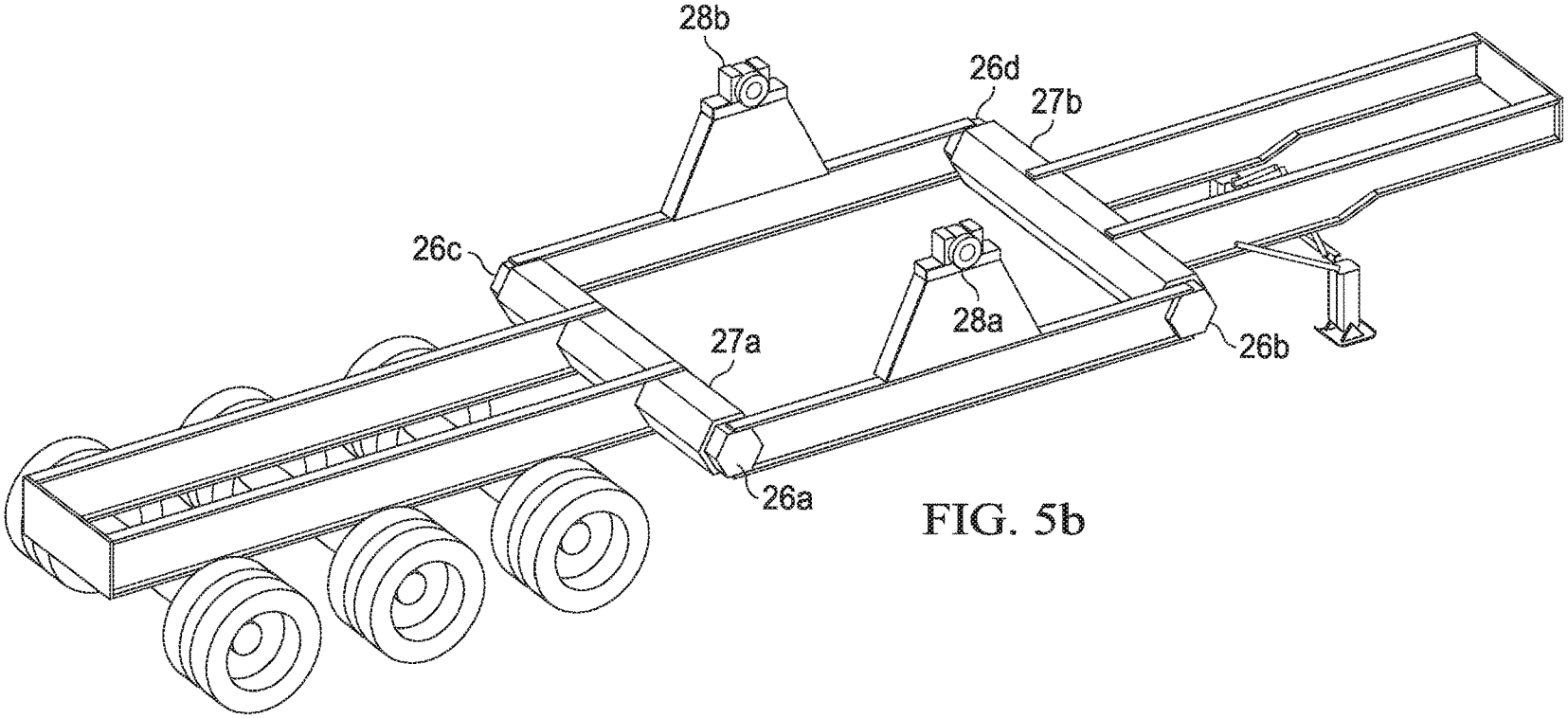
FIG. 5*b* depicts an isometric view of a coiled tubing transport trailer with variable width drop in drum system telescoped to a width suitable for legal highway transport.

Referring to FIG. 5*b*, the coiled tubing transport trailer (13) supports the slide mechanism (26*a*, 26*b*, 26*c*, 26*d*) which travels laterally along the axis of cross members (27*a*, 27*b*) to decrease the width between the coiled tubing reel support structures (28*a*) and (28*b*) to reduce the width of the coiled tubing transport trailer (13) to highway legal transport width and/or to accommodate smaller reel sizes.

The invention claimed is:

1. A method of assembling a coiled tubing rig comprising:

A. obtaining a coiled tubing service rig comprising:

i. a mast having a long axis;

ii. a base structure for the mast, the mast pivotally mounted to the base structure, wherein the mast is able to pivot from a position substantially parallel to ground to substantially perpendicular to ground;

iii. a coiled tubing injector mounted to the mast and able to travel longitudinally along the mast from a position near to the base structure when the mast is perpendicular to the ground to a position away from the base structure when the mast is perpendicular to the ground, the coiled tubing injector further being able to rotate from a position substantially parallel to the long axis to a position substantially perpendicular to the long axis; and iv. a pipe comprising at least one lubricator, the pipe further having one end being connected to the injector and another end not connected to the injector;

B. moving the injector to a position near the base structure when the mast is in a position perpendicular to the ground;

C. assembling a pipe with at least one lubricator in a position parallel to the ground;

D. connecting one end of the pipe to the injector;

E. running coiled tubing through the injector and out another end of the pipe;

F. connecting a downhole tool to the coiled tubing;

G. moving the injector to a position away from the base structure; wherein when the injector moves to a position away from the base structure, the pipe moves to a position perpendicular to the ground;

H. lowering the downhole tool and coiled tubing into a wellbore.

2. The method of claim 1, wherein when the pipe is in parallel position with respect to the ground, coiled tubing is capable of being passed through the injector in a horizontal position, through the lubricator and out the end of the lubricator oriented away from the tubing injector.

3. The method of claim 2, wherein a downhole tool is capable of being attached to the coiled tubing at or near the end of the pipe which is not connected to the tubing injector.

4. The method of claim 3, wherein movement of the injector to a position substantially away from the base structure, causes the pipe to move to a vertical position.

5. The method of claim 4, wherein movement of the injector causes the injector to rotate from a position substantially perpendicular to the long axis of the mast to a position substantially parallel to the long axis of the mast.

6. The method of claim 2, wherein the injector is capable of extending coiled tubing to the bottom of an elongated chain when the chain is either in a substantially vertical or substantially horizontal position.

7. The method of claim 1, wherein the pipe comprises a plurality of lubricators, each with a bottom end and a top end, wherein the top end of one of the plurality of lubricators is connected to the bottom end of another one of the plurality of lubricators, the plurality of lubricators forming an elongated chain of lubricators with a top end of the elongated chain connected to the injector.

8. The method of claim 1, wherein the coiled tubing is fed to the injector by a spool capable of rotation and positioned on a coiled tubing transporter trailer.

9. The method of claim 8, wherein the coiled tubing transporter trailer has length axis and a width, and wherein at least part of the transporter trailer is capable of increasing in width to accommodate a spool or decreasing in width when no spool is present.

10. The method of claim 1, wherein the mast is connected to a trailer and wherein when the mast is pivoted to a substantially horizontal position, the rig is capable of being transported on public roadways.

11. The method of claim 1, wherein when mast is perpendicular to the ground, the injector is capable of being in alignment with a wellbore or out of alignment with the wellbore.

* * * * *